United States Patent [19]

Workman

[11] Patent Number: 4,793,482

[45] Date of Patent: Dec. 27, 1988

[54] ONE-PIECE SHIM PACK

[75] Inventor: Gary L. Workman, Lombard, Ill.

[73] Assignee: Deslauriers, Incorporated, Bellwood, Ill.

[21] Appl. No.: 125,147

[22] Filed: Nov. 25, 1987

[51] Int. Cl.[4] ..... B65D 85/48

[52] U.S. Cl. ..... 206/343; 206/373; 206/451; 206/445; 206/554

[58] Field of Search ..... 206/554, 451, 343, 372, 206/494, 449, 71, 425, 445; 383/626

[56] References Cited

U.S. PATENT DOCUMENTS

| | | | |
|---|---|---|---|
| 3,044,233 | 7/1962 | Altman, Jr. | 206/451 |
| 3,329,260 | 7/1967 | Medleycott | 206/451 |
| 3,459,297 | 8/1969 | Templeton et al. | 206/451 |
| 3,618,752 | 11/1971 | Barker et al. | 206/451 |
| 3,987,901 | 10/1976 | Dullinger | 206/451 |
| 4,444,315 | 4/1984 | Gaskill, Jr. | 206/449 |
| 4,519,504 | 5/1985 | Nausedas | 206/449 |
| 4,570,796 | 2/1986 | Groom | 206/449 |

OTHER PUBLICATIONS

Pp. (15) and (15-1) of Deslauriers, Inc. price list published at least as of Mar. 1, 1986.

*Primary Examiner*—Joseph Man-Fu Moy
*Attorney, Agent, or Firm*—Wood, Dalton, Phillips, Mason & Rowe

[57] ABSTRACT

A one-piece shim pack having an assembled stack of generally rectangular multi-sided shims, all preferably of the same thickness, which are firmly held together by bonds extending along two adjacent sides of the shims. One or more shims may be peeled from the shim pack to achieve a desired usable height for the shim pack, with removal being achieved by breaking the bond of one or more shims and the unbroken bonds providing sufficient holding power wherein the shims remaining in the shim pack are firmly held together.

11 Claims, 1 Drawing Sheet

FIG. 1
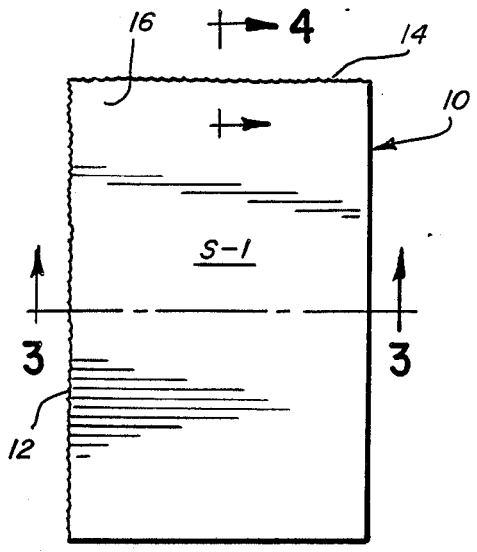
FIG. 2
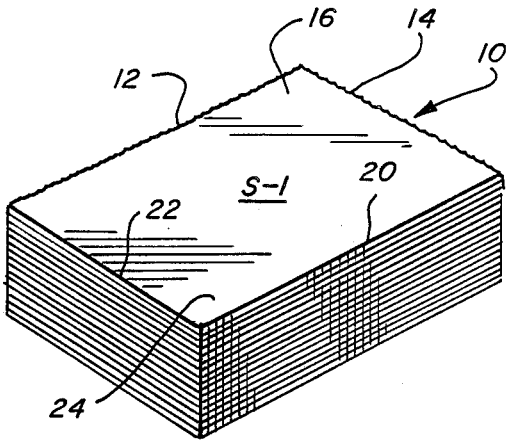
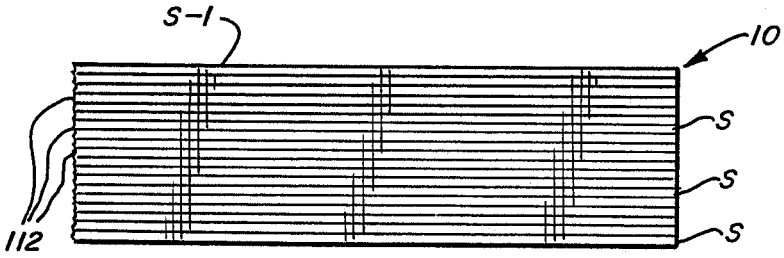
FIG. 3
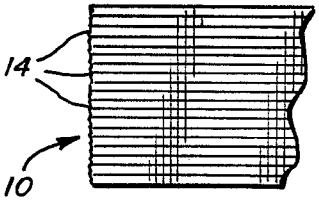
FIG. 4
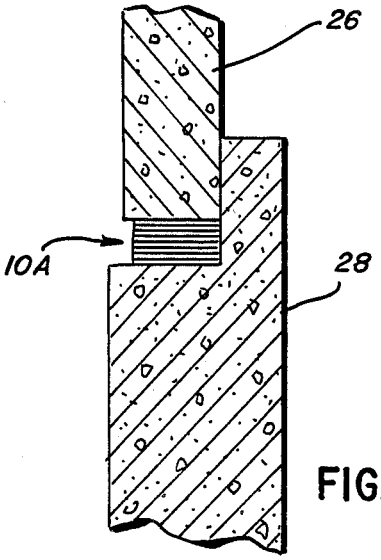
FIG. 5
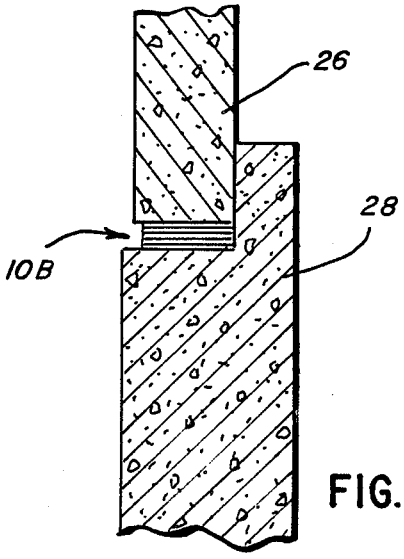
FIG. 6

ONE-PIECE SHIM PACK

1. Field of the Invention

This invention relates to a one-piece shim pack usable in the construction industry. The one-piece shim pack has a stack of generally rectangular shims providing a shim pack of a predetermined height. The shims are bonded together in a manner which enables peeling-off one or more shims to provide a height adjustment for the shim pack while holding the remainder of the shims firmly together to enable positioning of the shim pack at a desired location for use, such as for shimming in positioning of a heavy, concrete preformed wall panel on a foundation wall.

2. Background of the Invention

Various types of commercially-available shim products are used in the concrete construction industry. The shim products used primarily in shimming of superjacent preformed concrete wall panels or shimming a wall panel to a concrete foundation are of a plastic material having compressive strength.

One form of shim previously used embodies a series of shims, formed in a strip by extrusion followed by scoring of the strip to individualize the shims. The shim strips can then be stacked to provide the desired overall height and, if necessary, shims can be broken off from the strip to modify the length of the strips. Alternatively, shims can be broken off the strips for individual use.

A fairly versatile shim pack, commercially available for many years, embodies a plurality of stacked rectangular shims with three different thicknesses of shims being included in the shim pack. The shim packs are delivered to the site held in assembled relation by two crossed rubber bands to hold the shims in both directions. The height adjustment of the shim pack can then be varied by withdrawing one or more shims of the same or different thickness to provide the desired usable height for the shim pack established by the shims which are held in assembled relation by the rubber bands. In order to maintain the integrity of the assembled shim pack in shipment and in use, it is usual to hold the shims in assembled relation by two rubber bands at right angles to each other extending round the shims and, therefore, removal of one or more shims to achieve the desired height for the shim pack is a relatively cumbersome operation, with removal of at least one or both of the rubber bands and then replacing the rubber bands around the shims. Problems can arise if one of the rubber bands breaks. Typically, such shim packs are factory assembled from shims broken off of the previously described shim strips and, in so doing, the thickest of the shims have relatively rough edges resulting from the score line fracture.

Another type of shim, which is basically of a U-shape configuration, has been made of a thermoplastic material and these shims have been sold in stacked form with edge sections of adjacent shims bonded together by heat sealing, with the capability of peeling-apart one or more of the shims from the stack for individualized use of the shims or for using the remaining stack of shims. The bonding is done at two spaced locations along one edge of a shim and such localized bonding would not be adequate for the one-piece shim pack disclosed herein wherein the shims in the shim pack to be used must be held firmly together while still permitting peel-off of one or more shims from the shim pack.

Applicant's one-piece shim pack provides a rigidly secured-together stack of shims while still enabling easy peel-off of one or more shims to provide the desired usable height for the shim pack.

SUMMARY OF THE INVENTION

A primary feature of the invention is to provide a one-piece shim pack wherein a plurality of generally rectangular, multi-sided shims of plastic material are bonded together along substantially the entire length of two sides extending from a common corner of each shim to hold the shims of the shim pack firmly together while enabling ready height adjustment of the shim pack by lifting the diagonally opposite corner and adjacent sides of the uppermost shim in the shim pack for peeling the shim from the shim pack by breaking of the bond along the two sides of the shim.

A specific embodiment of the one-piece shim pack having the aforesaid feature has a plurality of generally rectangular multi-sided shims formed of plastic material, such as polystyrene, with the shims stacked one upon the other and having heat seal bonds extending along one long side and one short side of the shims, leaving one long side and one short side free of bonds whereby a shim may be lifted from the shim pack for breaking of the bonds to reduce the height of the shim pack.

Additionally, the one-piece shim pack can have all of the shims of the same thickness to avoid the selectivity in removal of different thickness shims to achieve a usable height, as required in the prior art shim pack where the shims were of different thicknesses.

An object of the invention is to provide a new and improved one-piece shim pack.

Another object of the invention is to provide a shim pack having a plurality of multi-sided generally rectangular shims wherein less than all of the shims can be used to provide a desired usable height of the shim pack determined by the shims remaining in the pack, the improvement wherein the shim pack is of a one-piece construction having a plurality of stacked individual shims bonded together along substantially the entire length of two sides extending from a common corner of the shims in order to securely hold the shims in associated relation while still enabling the peeling of one or more shims from the pack to achieve the desired height for the shim pack.

Still another object of the invention is to provide a unitary one-piece pack of shims facilitating overall height adjustment of the pack comprising, a plurality of generally rectangular shims of uniform thickness stacked one upon another, said shims being of a thermoplastic material, and said pack of shims being heat sealed together along the edges of two adjacent sides extending from a common corner of adjacent shims to form bonds and maintain the integrity of the pack of shims while enabling release of one or more shims from the pack to achieve a pack of the desired height by lifting the shims to be removed from the pack a sufficient distance to break the bonds thereof to the remainder of the pack.

DESCRIPTION OF THE DRAWINGS

FIG. 1 is a plan view of the one-piece shim pack;

FIG. 2 is a perspective view thereof;

FIG. 3 is a vertical section, taken generally along the line 3—3 in FIG. 1 and on an enlarged scale;

FIG. 4 is a fragmentary section, taken generally along the line 4—4 in FIG. 1 and on an enlarged scale;

FIG. 5 is a fragmentary vertical section through a building wall panel and foundation showing use of a one-piece shim pack of one height; and FIG. 6 is a view, similar to FIG. 5, showing use of a one-piece shim pack of a different height.

DESCRIPTION OF THE PREFERRED EMBODIMENT

The one-piece shim pack, identified generally at 10, has an aligned stack of generally rectangular, multi-sided shims S, with the uppermost shim being identified as shim S-1. Each of the shims is of a multi-sided, generally rectangular construction and, in a commercial embodiment, each of the shims is of the same thickness, specifically 1/16th of an inch and with there being 17 shims in the shim pack, the maximum height thereof is 11/16", which is the same height as provided in the prior art rubber-banded shim pack having a lesser number of shims, but with one or more of the shims having other thicknesses, such as ¼" and ⅛".

The shims are each relatively rigid, with some flexibility and are formed of plastic material having substantial compressive strength and, more particularly, thermoplastic material, such as high impact polystyrene. In assembling a stack of shims, the shims can be individualized by break-off from a shim strip having a plurality of shims with score lines in between or the shims may be formed individually.

The shims in the shim pack are held together firmly by bonds along two sides of adjacent shims, with a first bond 12 extending along one long side of each of the shims and a second bond 14 extending along an adjacent short side of each of the shims and with a common corner 16 of a shim therebetween. Each of the bonds 12 and 14 may be achieved chemically by use of a contact adhesive with an example of such product being a 30-NF contact adhesive, marketed by the 3M Company. Preferably, each of the bonds is formed by heat sealing, with an assembled stack of shims having the long side and then the short side successively pressed against a hot plate to form the bonds 12 and 14. These bonds result in a relatively smooth surface, with the irregularity of the bonds 12 and 14 being exaggerated in FIGS. 1 to 4 for illustrative purposes. As clearly shown in FIGS. 3 and 4, each shim is securely held to adjacent shims by the bonds 12 and 14.

A remaining long side 20 and short side 22 of each shim is free from any bond to adjacent shims. As a result, the shim S-1, or a plurality of shims including shim S-1 and shims immediately therebeneath may be lifted relative to the remaining shims in the shim pack by application of a lifting force in the general area of a shim corner 24 diagonally opposite the shim common corner 16, with separation of the bonds 12 and 14 between the uppermost shim remaining in the shim pack and the lifted shims. The extensive bonds 12 and 14 function to securely hold the nonlifted shims in the one-piece shim pack during peel-off of one or more shims as well as during use of the shim pack. Each of the shims has sufficient strength whereby lifting of a shim by force applied in the area of the shim corner 24 will result in some flexing of the shim but adequate force is transmitted through the shim to separate the bonds 12 and 14 along the two sides of the shim.

With the structure of the shim pack, it is possible to easily adjust the height thereof by one or more times peeling-off one or two shims, so that the shim pack can be of a desired usable height. An illustrative use of the shim pack is given in FIGS. 5 and 6 wherein a preformed concrete wall panel 26 is to be mounted on a concrete foundation 28. In order to achieve perfect levelling of the wall panel 26 it is necessary to provide shimming by means of shim packs 10A and 10B at different locations along the length of the wall panel. The shim pack 10A uses a major portion of the shims in a shim pack 10, while the shim pack 10B uses a lesser number. After proper positioning of the shim packs spaced along the length of the foundation 28 a grout, in the form of a concrete mix can be applied between the foundation and the wall panel with enclosure of the shim packs 10A and 10B for permanent support of the wall panel relative to the foundation.

From the foregoing, it will be evident that a one-piece shim pack is uniquely designed to achieve results not heretofore known. An assembled stack of shims are bonded together in a special manner by elongate bonds 12 and 14 along two sides of each shim to assure that the shims in the shim pack will be firmly held together while still enabling separation of one or more shims to adjust the height of the shim pack for use. The utility of the product is further enhanced by having all of the shims of the same thickness wherein a number of shims equal to the reduction in height of the shim pack desired may be separated from the shim pack by breaking the bonds 12 and 14. This avoids the problems that exist in use of the shim pack that has been available for many years wherein shims of various thicknesses are held in assembled relation by rubber bands which requires: (1) the removal of the rubber bands; (2) a selection as to which of the shims of various thicknesses, one or more of which may be intermediate the bottom and top of the shim pack, must be removed to achieve the desired height of the shim pack; and (3) replacement of the rubber bands to hold the loose shims of the shim pack in place for use. Normally, a user will "eyeball" a complete shim pack in position to determine the desired final height and then remove the shims necessary to achieve that height.

I claim:

1. A shim pack having a plurality of multi-sided generally rectangular shims wherein less than all of the shims can be used to provide a desired usable height of the shim pack determined by the shims remaining in the pack, the improvement wherein the shim pack is of a one-piece construction having a plurality of stacked individual shims bonded together along substantially the entire length of two sides extending from a common corner of the shims in order to securely hold the shims in associated relation while still enabling the peeling of one or more shims from the pack to achieve the desired height for the shim pack.

2. A shim pack as defined in claim 1 wherein said shims are of thermoplastic material.

3. A shim pack as defined in claim 2 wherein said shims are bonded together by heat seals along said two sides.

4. A shim pack as defined in claim 2 wherein said thermoplastic material is polystyrene.

5. A shim pack as defined in claim 1 wherein all of said shims are of the same thickness.

6. A shim pack as defined in claim 1 wherein said shims are of equal thickness and of thermoplastic material and said bonding together is achieved by heating of the shims along said two sides to achieve a plastic bond.

7. A one-piece shim pack comprising, a plurality of stacked generally rectangular shims of plastic material, and means for holding said shims in assembled relation while permitting removal of one or more shims to achieve the desired usable height for the shim pack, said means comprising an edge bond between adjacent shims extending along two adjacent sides of each shim which extend from a common corner of the shims whereby a corner diagonally opposite from said common corner and shim sides adjacent said diagonally opposite corner are free of any bond to enable lifting of said diagonally opposite corner and shim sides adjacent thereto to detach a shim from the shim pack.

8. A one-piece shim pack as defined in claim 7 wherein said shims are of sufficient thickness to maintain a substantially planar configuration as a diagonally opposite corner is lifted and the bond of the lifted shim to an adjacent shim is broken.

9. A one-piece shim pack as defined in claim 8 wherein said shims are all of the same thickness.

10. A one-piece shim pack as defined in claim 8 wherein said plastic is a thermoplastic and said edge bond is achieved by application of heat to the edges of said shims.

11. A unitary one-piece pack of shims facilitating overall height adjustment of the pack comprising, a plurality of generally rectangular shims of uniform thickness stacked one upon another, said shims being of a thermoplastic material, and said pack of shims being heat sealed together along the edges of two adjacent sides extending from a common corner to form bonds and maintain the integrity of the pack of shims while enabling release of one or more shims from the pack to achieve a pack of the desired usable height by pulling the shims to be removed from the pack a sufficient distance to break the bonds thereof to the remainder of the pack.

* * * * *